United States Patent [19]

Johnson

[11] Patent Number: 4,769,991

[45] Date of Patent: Sep. 13, 1988

[54] BALANCED HYDRAULIC PROPULSION SYSTEM

[75] Inventor: Steven H. Johnson, Dubuque, Iowa

[73] Assignee: Deere & Company, Moline, Ill.

[21] Appl. No.: 117,459

[22] Filed: Nov. 3, 1987

Related U.S. Application Data

[63] Continuation of Ser. No. 16,318, Feb. 19, 1987, abandoned.

[51] Int. Cl.[4] ..... F15B 13/06

[52] U.S. Cl. ..... 60/426; 60/427; 180/6.48

[58] Field of Search ..... 60/426, 427; 180/6.48

[56] References Cited

U.S. PATENT DOCUMENTS 3,912,057 10/1975 Krouse et al. .

4,177,870 12/1979 Henn .

4,261,431 4/1981 Hawbaker ..... 60/427 X

*Primary Examiner*—Gerald A. Michalsky

[57] ABSTRACT

A large industrial earthmoving machine having a hydraulic propulsion system comprising at least two hydraulic motors which are powered from a source of hydraulic fluid to drive a common load. Each motor of the hydraulic propulsion system is provided with two compensating valve assemblies. Each compensating valve assembly is provided with a compensating spool and a shuttle spool to provide accurate control of the hydraulic motors. In each pair of compensating valve assemblies, there is a forward compensating valve assembly and a backward valve assembly respectively controlling forward and backward movement of the hydraulic motor. Between the both forward compensating valve assemblies and the respective hydraulic motors, the compensating valve assemblies are fluidically coupled to one another by a small hydraulic communication line that better equalizes hydraulic fluid flow to the motors and prevents domination of one forward compensating valve assembly over the other. Similarly, the backward compensating valve assemblies are provided with an identical small hydraulic communication line accomplishing the same results.

17 Claims, 2 Drawing Sheets

BALANCED HYDRAULIC PROPULSION SYSTEM

This application is a continuation of application Ser. No. 016,318, filed Feb. 19, 1987 now abandoned.

BACKGROUND OF THE INVENTION

1. Field of the Invention

The invention is directed to a hydraulic propulsion system for a large industrial machine such as an excavator. The machine has at least two hydraulic propulsion motors which are driven from the same source of hydraulic pressure.

2. Description of the Prior Art

Large industrial machines are propelled many times by hydraulic motors. Typically, such machines are provided with internal combustion engines that are used to drive hydraulic pumps. The hydraulic pumps draw hydraulic fluid from a sump and pump the hydraulic fluid into hydraulic lines where it is directed to the propulsion motors and other operating members. Individual three-position directional control valves are used to control the flow of hydraulic fluid to each of the motors, thereby controlling the propulsion motors and other hydraulic motors used for driving the operating members.

In simple hydraulic systems, hydraulic fluid takes the path of least resistance and flows to the area requiring the lowest pressure. This is especially troublesome wherein two hydraulic motors are being used to move a common load, for example two crawler tracks of a crawler excavator, because the low pressure motor will command more hydraulic fluid resulting in an uneven operation of the two motors. To overcome this natural tendency of the hydraulic fluid, compensator valve assemblies are provided to better balance the flow between the two motors by having the high pressure compensator valve assembly meter the low pressure side to even the pressure between the two assemblies.

Although compensator systems work well in most instances, another problem develops when the loads are equal or close to being equal. This situation is noticeable when a crawler operator wants to go in a straight line wherein the tracks need to move equally to accomplish this task. The crawler operator would notice that the crawler would tend to turn to one side or the other as it moves. Therefore, the operator has to continually adjust for this turning movement in the crawler. This situation arises because one of the compensator valve assemblies is dominating the other compensator valve assembly effectively reducing flow through one of the hydraulic motors. This typically happens because the directional control valves are never opened simultaneously and the directional control valve that is opened first creates a dominating compensator valve assembly as it becomes the high pressure compensator valve. The compensator valve assembly associated with the latter opening directional control valve becomes dominated by earlier opening and now high pressure compensator valve assembly and tends to reduce flow to the hydraulic motor to which it is associated. Therefore, the hydraulic motor associated with the first opening directional control valve moves faster than the motor associated with the latter opening directional control valve resulting in a turning movement by the crawler.

SUMMARY OF THE INVENTION

The present invention is designed to overcome this problem with compensator valve assemblies by providing a small communication hydraulic line between the downstream hydraulic paths of the two compensator valve assemblies. A source of hydraulic fluid supplies hydraulic fluid to two directional control valves each of which direct pressurized hydraulic fluid to a pair of downstream compensator valve assemblies. Each pair of compensator valve assemblies is provided with a forward compensator valve assembly for controlling forward movement of the crawler and a backward compensator valve assembly for controlling the backward movement of the crawler. The position of the directional control valve determines which one of the compensator valve assemblies in each pair of compensator valves the hydraulic fluid is directed to, thereby controlling the movement of the crawler. Two small communication hydraulic lines are provided for transmitting hydraulic fluid between the two forward compensator valve assemblies and the two backward compensator valve assemblies.

DETAILED DESCRIPTION

Figure 1:
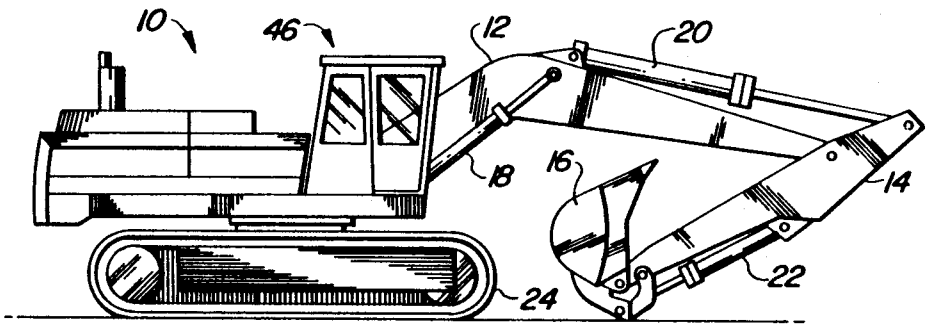
FIG. 1 is a side view of a crawler excavator.

FIG. 1 illustrates an excavator crawler to which the present hydraulic propulsion is particularly well suited. Excavator 10 is provided with a movable boom 12, dipper 14 and bucket 16. The boom, dipper and bucket are controlled by linear hydraulic motors 18, 20, and 22, respectively. Excavator crawler 10 is a self-propelled excavator being supported on two ground engaging tracks 24 (only one shown) which are used to drive and position the excavator at a work site.

The tracks are independently driven by rotary hydraulic motors 26 and 28 which are coupled through compensator valve assemblies 30, 32, 34 and 36 to directional control valves 38 and 40. Hydraulic fluid is pumped to the directional control valves 38 and 40 from sump 42 by hydraulic pump 44. The hydraulic pump is driven by an internal combustion engine mounted in the excavator. The operator in cab 46 can move or position the excavator by manipulating the directional control valves to propel the excavator forward or backward, or turning the excavator by operating hydraulic motors 26 and 28 in different directions or at different speeds.

It should be noted that although the invention is being described with regards to an excavator crawler propulsion system, the present invention could be utilized in a number of hydraulic applications wherein two independently controlled hydraulic motors drive a common load from a single source of pressurized hydraulic fluid.

Figure 2:
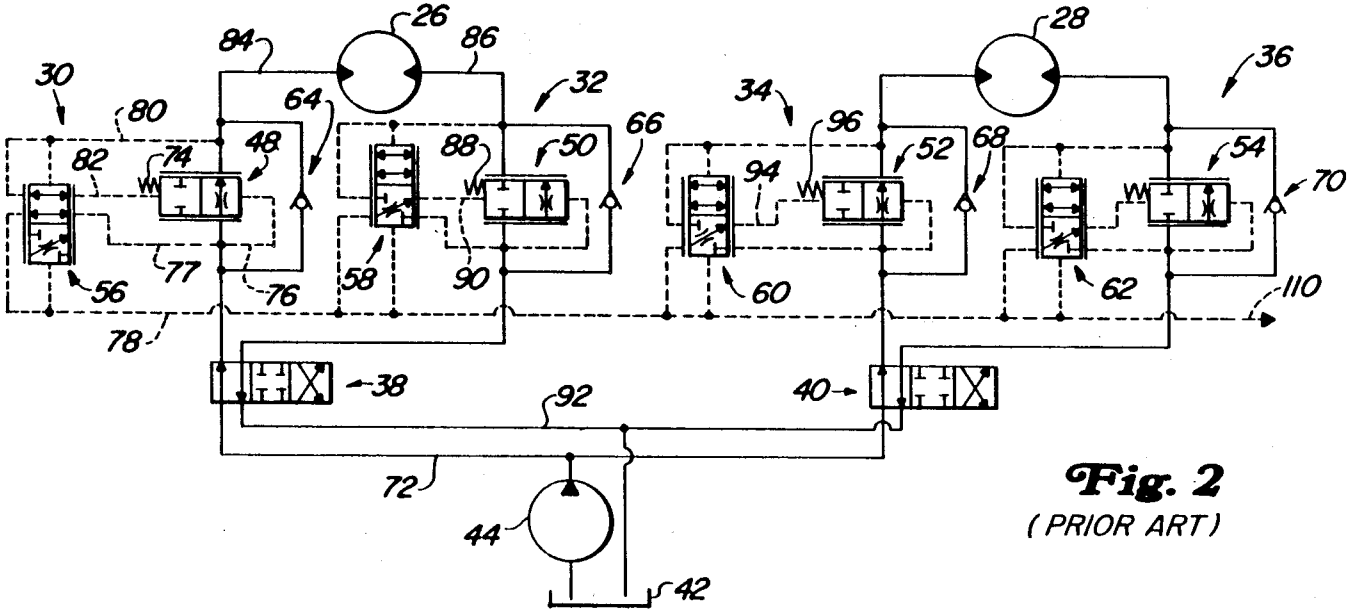
Fig. 2 (PRIOR ART)
FIG. 2 is a hydraulic schematic of a prior art hydraulic propulsion system for an excavator crawler without the small communication line.

FIG. 2 is the prior art hydraulic schematic of the hydraulic propulsion system without the small balancing communication line between the downstream output of the compensator valve assemblies. Each compensator valve assembly is provided with a metering compensator spool 48, 50, 52 and 54, a shuttle spool 56, 58, 60 and 62, and a return flow check valve 64, 66, 68 and 70. For forwardly driving motor 26 hydraulic pump 44 pumps hydraulic fluid into hydraulic pumping line 72 to directional control valve 38. The directional control valve 38 directs the fluid to forward compensator valve assembly 30 and specifically to metering two-position compensator spool 48 having a restricted orifice position and a checked position. Spool 48 is spring biased into a closed position by spring 74 which is overcome by hydraulic pressure in sensing line 76 which pushes the valve into the open position. Hydraulic pressure from line 72 is also directed through hydraulic line 77 to shuttle spool 56 and 25 into compensation communication line 78. Shuttle spool 56 is hydraulically balanced by the hydraulic pressure in line 78 and the pressure downstream of compensator spool 48 as transmitted through line 80. The hydraulic fluid in line 80 is used both for balancing spool 56 and for flowing through spool 56 to line 82 to balance spool 48 by adding to the biasing force of spring 74.

Hydraulic fluid passing through valve 48 into line 84 is directed to motor 26 driving one of the crawler tracks of the excavator. The exhausted hydraulic fluid then passes into line 86 where it is directed to backward compensator valve assembly 32. As shuttle spool 58 is shifted into the closed position by the hydraulic pressure in compensator communication line 78, and spool 50 is closed by the biasing force of spring 88 and the hydraulic pressure in line 90 which is fluidically coupled to compensator communication line 78 by the closed position of spool 58; the exhausted fluid passes through check valve 66 and into exhaust hydraulic line 92 wherein it is directed into sump 42. Hydraulic fluid does not pass through check valve 64 of compensator valve assembly 30 because of the pressure drop across the restricted orifice of spool 48.

In FIG. 2, both motors are being driven in the same forward direction as determined by directional control valves 38 and 40. However, compensator valve assembly 30 has become dominant, either because it was triggered first by the operator or because of shorter hydraulic line connections when compared with compensator valve assembly 34. Compensator valve assembly 34 works in an identical manner to that of compensator valve assembly 30 except that because of the hydraulic pressure in compensation communication line 78 shuttle spool 60 tends to be biased into a closed position which in turn directs hydraulic pressure from line 78 through shuttle spool 60 and hydraulic line 94 to aid spring 96 in biasing compensator spool 52 closed.

It should be noted that the shuttle and compensating spools are two-position metering spools which are hydraulically balanced. As such, the spools are reciprocated between each of the two positions during operation and they do not normally maintain a fixed position. Therefore, in viewing FIG. 2, it should be noted that dominating compensating spool 48 in compensating valve assembly 30 is opened and transmits more hydraulic fluid because of its higher pressure, if it is the dominating valve assembly, and compensating spool 52, of compensating valve assembly 34 transmits less hydraulic fluid because of its lower hydraulic pressure when compared to dominating compensating valve assembly 30.

As with compensating valve assemblies 30 and 32, hydraulic fluid from pump 44 flows through pumping line 72 to directional control valve 40 where it is transmitted to compensating spool 52. Hydraulic fluid passes through the restricted orifice in compensating spool 52 and is directed to motor 28 from which it is exhausted to compensating valve assembly 36. As with compensating valve assembly 32, hydraulic fluid is prevented from passing through compensating spool 54 and instead passes through check valve 70 and back to sump 42. The balancing hydraulic lines for all of the compensating spools and shuttles spools of compensating valve assemblies 32, 34 and 36 are identical to those explained with regards to compensating valve assembly 30 and function in the same manner.

If the excavator crawler is to be reversed, directional control valves 38 and 40 are moved to the left to direct pumping fluid to backward compensating valve assemblies 32 and 36. In this situation, the pumps exhaust hydraulic fluid through check valves 64 and 68, respectively. To pivot the machine, one hydaulic motor is operated in the forward direction and the other in a reverse direction. The excavator itself can be pivoted on the tracks which means that since the hydraulic motors are adjacent to the tracks, the hydraulic lines leading from the pump to the motors must pass through a hydraulic line swivel (not shown) which is well known in the art.

Figure 3:
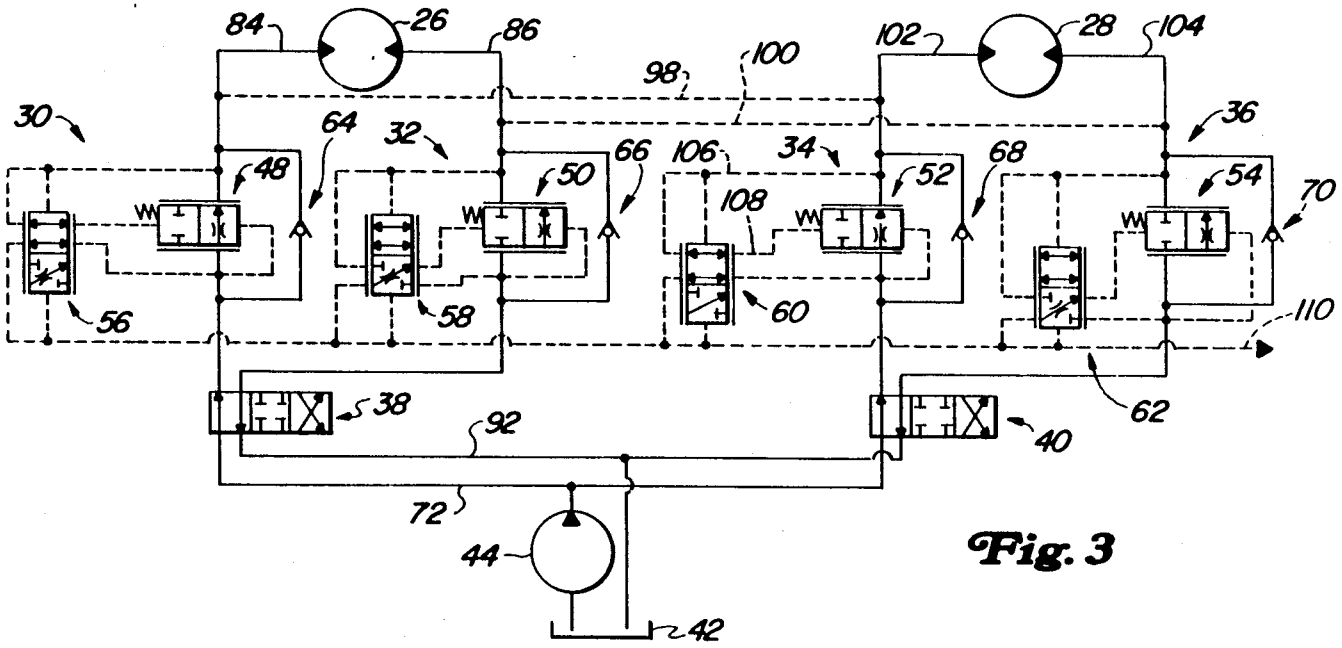
FIG. 3 is a hydraulic schematic of a hydraulic propulsion system for an excavator crawler with the small communication line.

FIG. 3 illustrates the small communication hydraulic lines used for overcoming the problem illustrated in FIG. 2. Hydraulic lines 98 and 100 fluidically couple hydraulic line 84 to line 102, and line 86 to line 104, respectively. When the excavator crawler is moving forward, line 98 tends to equalize the hydraulic pressure between compensating valve assembly 30 and compensating valve assembly 34. As compensating valve assembly 30 tries to dominate valve assembly 34, hydraulic fluid pressure increases in line 84 increasing the pressure in line 98 and line 102 which in turn increases pressure in line 106 causing metering shuttle spool 60 to remain open for transmitting pressure through line 108 to help bias compensating spool 52 open, and better equalizing the hydraulic flow to both motors. During forward movement, exhaust lines 86 and 104 are joined by line 100, but this does not effect the operation of the system because the hydraulic pressure in compensating line 78 serves to maintain compensating valve assemblies 32 and 36 closed except for the normal exhaust flow through check valves 66 and 70.

In reversing the excavator crawler, communication line 100 would prevent either compensating valve assembly 32 or 36 from dominating one another. As with the forward operation, exhaust lines 84 and 102, even through coupled through line 98, would not effect operation of the compensating valve assemblies.

To prevent inexact operations, lines 98 and 100 must be quite small when compared to hydraulic lines 84, 86, 102 and 104 which are used to transfer hydraulic fluid to the pumps. For example, lines 84, 86, 102 and 104 can be 0.75 inches in diameter and in accordance therewith communication lines 98 and 100 should be 0.25 inches in diameter. In addition, lines 98 and 100 should be provided with an orifice further restricting flow. This orifice should be 0.004 inches in diameter to further reduce the cross flow between the pumping lines.

Compensating communication line 78 serves an additional function as indicated by arrow 110 and that is to provide a pressure sensing circuit with a hydraulic feedback to better control the operation of the hydraulic pump.

The present invention described above should not be limited by the above described embodiments, but should be limited solely by the claims that follow.

I claim:

1. A hydraulic system for operating a plurality of hydraulic motors from a source of hydraulic pressure, the system comprising:

a source of pressurized hydraulic fluid;

a first hydraulic motor;

a first compensating valve assembly fluidically coupled to the source of pressurized hydraulic fluid for receiving pressurized hydraulic fluid therefrom;

a first hydraulic line located between the first compensating valve assembly and the first hydraulic motor for directing pressurized hydraulic fluid from the first compensating valve assembly to the first hydraulic motor;

a second hydraulic motor;

a second compensating valve assembly fluidically coupled to the source of pressurized hydraulic fluid for receiving pressurized hydraulic fluid therefrom;

a second hydraulic line located between the second compensating valve assembly and the second hydraulic motor for directing pressurized hydraulic fluid from the second compensating valve assembly to the second hydraulic motor;

a communication hydraulic line fluidically coupling the first hydraulic line to the second hydraulic line to better balance the flow of pressurized hydraulic fluid from the source of pressurized hydraulic fluid to the first and second hydrallic motors;

a third compensating valve assembly fluidically coupled to the source of pressurized hydraulic fluid for receiving pressurized hydraulic fluid therefrom;

a third hydraulic line located between the third compensating valve assembly and the first hydraulic motor for directing pressurized hydraulic fluid from the third compensating valve assembly to the first hydraulic motor;

a fourth compensating valve assembly fluidically coupled to the source of pressurized hydraulic fluid for receiving pressurized hydraulic fluid therefrom;

a fourth hydraulic line located between the fourth compensating valve assembly and the second hydraulic motor for directing pressurized hydraulic fluid from the fourth compensating valve assembly to the second hydraulic motor; and a second communication hydraulic line fluidically coupling the third hydraulic line to the fourth hydraulic line to better balance the flow of pressurized hydraulic fluid from the source of pressurized hydraulic fluid to the first and second hydraulic motors.

2. A hydraulic system as defined by claim 1 wherein the first, second, third and fourth compensating valve assemblies are respectively provided with a first, second, third and fourth bypass hydraulic lines which permit the return of hydraulic fluid from the first and second hydraulic motors to the source of pressurized hydraulic fluid, each of the bypass hydraulic lines are provided with at least one check valve which permits the flow of hydraulic fluid in only one direction, that is frcm the hydraulic motors to the source of pressurized hydraulic fluid.

3. A hydraulic system as defined by claim 2 further comprising first and second three-position directional control valves which are respectively positioned fluidically between the first and third, and second and fourth compensating valve assemblies and the source of pressurized fluid.

4. A hydraulic system as defined by claim 3 wherein each of the compensator valve assemblies are fluidically coupled to one another by a compensation communication hydraulic line.

5. A hydraulic system as defined by claim 4 wherein each compensator valve assembly is provided with a metering two-position compensator spool and a metering two-position shuttle spool.

6. A propulsion system for an industrial machine having a hydraulic system for operatinve a plurality of hydraulic propulsion motors for moving the machine, the machine comprising:

a source of pressurized fluid;

a first hydraulic propulsion motor operatively coupled to an operative member adapted and constructed to move the machine;

a first compensating valve assembly fluidically coupled to the source of pressurized hydraulic fluid for receiving pressurized hydraulic fluid therefrom;

a first hydraulic line located between the first compensating valve assembly and the first hydraulic motor for directing pressurized hydraulic fluid from the first compensating valve assembly to the first hydraulic motor;

a second hydraulic propulsion motor operatively coupled to an operative member adapted and constructed to move the machine;

a second compensating valve assembly fluidically coupled to the source of pressurized hydraulic fluid for receiving pressurized hydraulic fluid therefrom;

a second hydraulic line located between the second compensating valve assembly and the second hydraulic motor for directing pressurized hydraulic fluid from the second compensating valve assembly to the second hydraulic motor;

a communication hydraulic line fluidically coupling the first hydraulic line to the second hydraulic line to better balance the flow of pressurized hydraulic fluid from the source of pressurized hydraulic fluid to the first and second hydraulic motors;

a third compensating valve assembly fluidically coupled to the source of pressurized hydraulic fluid for receiving pressurized hydraulic fluid therefrom;

a third hydraulic line located between the third compensating valve assembly and the first hydraulic motor for directing pressurized hydraulic fluid from the third compensating valve assembly to the first hydraulic motor;

a fourth compensating valve assembly fluidically coupled to the source of pressurized hydraulic fluid for receiving pressurized hydraulic fluid therefrom;

a fourth hydraulic line located between the fourth compensating valve assembly and the second hydraulic motor for directing pressurized hydraulic fluid from the fourth compensating valve assembly to the second hydraulic motor; and a second communication hydraulic line fluidically coupling the third hydraulic line to the fourth hydraulic line to better balance the flow of pressurized hydraulic fluid from the source of pressurized hydraulic fluid to the first and second hydraulic motors.

7. A propulsion system as defined by claim 6 wherein the first, second, third and fourth compensating valve assemblies are respectively provided with a first, second, third and fourth bypass hydraulic lines which permit the return of hydraulic fluid from the first and second hydraulic motors to the source, of pressurized hydraulic fluid, each of the bypass hydraulic lines are provided with at least one check valve which permits the flow of hydraulic fluid in only one direction, that is from the hydraulic motors to the source of pressurized hydraulic fluid.

8. A propulsion system as defined by claim 7 further comprising first and second three-position directional control valves which are respectively positioned fluidically between the first and third, and second and fourth compensating valve assemblies and the source of pressurized fluid.

9. A propulsion system as defined by claim 8 wherein eact of the compensator valve assemblies are fluidically coupled to one another by a compensation communication hydraulic line.

10. A propulsion system as defined by claim 9 wherein each compensator valve assembly is provided with a metering two-position compensator spool and a metering two-position shuttle spool.

11. A self-propelled excavator having a hydraulic propulsion system, the excavator is provided with a frame on which is mounted a digging arm having a movable boom member, a movable dipper member and a movable bucket each of which are oved by independent linear hydraulic motors, the frame is also provided with ground engaging means for supporting the excavator and on which the excavator is propelled over the ground, the improvement comprising:

a source of pressurized hydraulic fluid;

a first hydraulic propulsion motor operatively coupled to the ground engaging means for propelling the excavator;

a first compensating valve assembly fluidically coupled to the source of pressurized hydraulic fluid for receiving pressurized hydraulic fluid therefrom;

a first hydraulic line located between the first compensating valve assembly and the first hydraulic motor for directing pressurized hydraulic fluid from the first compensating valve assembly to the first hydraulic motor;

a second hydraulic propulsion motor operatively coupled to the ground engaging means for propelling the excavator;

a second compensating valve assembly fluidically coupled to the source of pressurized hydraulic fluid for receiving pressurized hydraulic fluid therefrom;

a second hydraulic line located between the second compensating valve assembly and the second hydraulic motor for directing pressurized hydraulic fluid from the second compensating valve assembly to the second hydraulic motor;

a communication hydraulic line fluidically coupling the first hydraulic line to the second hydraulic line to better balance the flow of pressurized hydrualic fluid from the source of pressurized hydraulic fluid to the first and second hydraulic motors;

a third compensating valve assembly fluidically coupled to the source of pressurized hydraulic fluid for receiving pressurized hydraulic fluid therefrom;

a third hydraulic line located between the third compensating valve assembly and the first hydraulic motor for directing pressurized hydraulic fluid from the third compensating valve assembly to the first hydraulic motor;

a fourth compensating valve assembly fluidically coupled to the source of pressurized hydraulic fluid for receiving pressurized hydraulic fluid therefrom;

a fourth hydraulic line located between the fourth compensating valve assembly and the second hydraulic motor for directing pressurized hydraulic fluid from the fourth compensating valve assembly to the second hydralic motor; and a second communication hydraulic line fluidically coupling the third hydraulic line to the fourth hydraulic line to better balance the flow of pressurized hydraulic fluid from the source of pressurized hydraulic fluid to the first and second hydraulic motors.

12. An excavator as defined by claim 11 wherein the first, second, third and fourth compensating valve assemblies are respectively provided with a first, second, third and fourth bypass hydraulic lines which permit the return of hydraulic fluid from the first and second hydraulic motors to the source of pressurized hydraulic fluid, each of the bypass hydraulic lines are provided with at least one check valve which permits the flow of hydraulic fluid in only one direction, that is from the hydraulic motors to the source of pressurized hydraulic fluid.

13. An excavator as defined by claim 12 further comprising first and second three-position directional control valves which are respectively positioned fluidically between the first and third, and second and fourth compensating valve assemblies and the source of pressurized fluid.

14. An excavator as defined by claim 13 wherein each of the compensator valve assemblies are fluidically coupled to one another by a compensation communication hydraulic line.

15. An excavator as defined by claim 14 wherein each compensator valve assembly is provided with a metering two-position compensator spool and a metering two-position shuttle spool.

16. An excavator as defined by claim 15 wherein all of the compensator spools are hydraulic balanced between the source of pressurized hydraulic fluid and the pressurized hydraulic fluid located in the respective hydraulic line of the respective compensator valve assembly as metered by the respective shuttle spool.

17. An excavator as defined by claim 12 wherein the cross sectional area of the first and second communication hydraulic lines are smaller than the cross sectional area of the first, second, third and fourth hydraulic lines.

* * * * *